US007175492B1

(12) United States Patent
Butler

(10) Patent No.: US 7,175,492 B1
(45) Date of Patent: Feb. 13, 2007

(54) UNITARY REEL MARKER BUOY SYSTEM

(76) Inventor: David O. Butler, 456 Denise St., Tarpon Springs, FL (US) 34689

( * ) Notice: Subject to any disclaimer, the term of this patent is extended or adjusted under 35 U.S.C. 154(b) by 0 days.

(21) Appl. No.: 11/487,208

(22) Filed: Jul. 14, 2006

(51) Int. Cl.
*B63B 22/20* (2006.01)

(52) U.S. Cl. ..... 441/26

(58) Field of Classification Search ..... 441/26
See application file for complete search history.

(56) References Cited

U.S. PATENT DOCUMENTS

RE28,296 E * 1/1975 Mallette ..... 242/573.9
5,376,035 A * 12/1994 Forrest ..... 441/26

* cited by examiner

*Primary Examiner*—Stephen Avila

(74) *Attorney, Agent, or Firm*—Edward P. Dutkiewicz

(57) ABSTRACT

A buoyant assembly has a central reel and end rings. The central reel has a central support section with end sections. The end sections of the central reel are coupled to the end reels. The central reel and end rings are fabricated from a buoyant elastomer. A line has an interior end coupled to the central support section. The line has an exterior end with a weight secured thereto. The line has an intermediate length there between coiled around the central support section. Handles are adapted to move between retracted and extended orientations. The handles are adapted to be moved to their extended orientations for winding line onto the central support section. The handles are adapted to be moved to their retracted orientations when floating in water with the line unwound to mark an underwater site of interest.

13 Claims, 5 Drawing Sheets

FIG 1
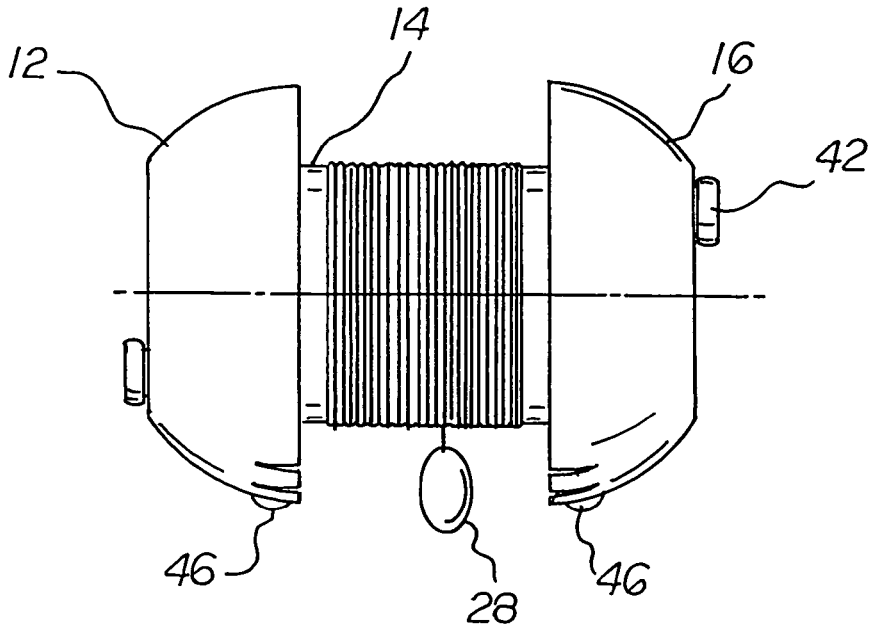
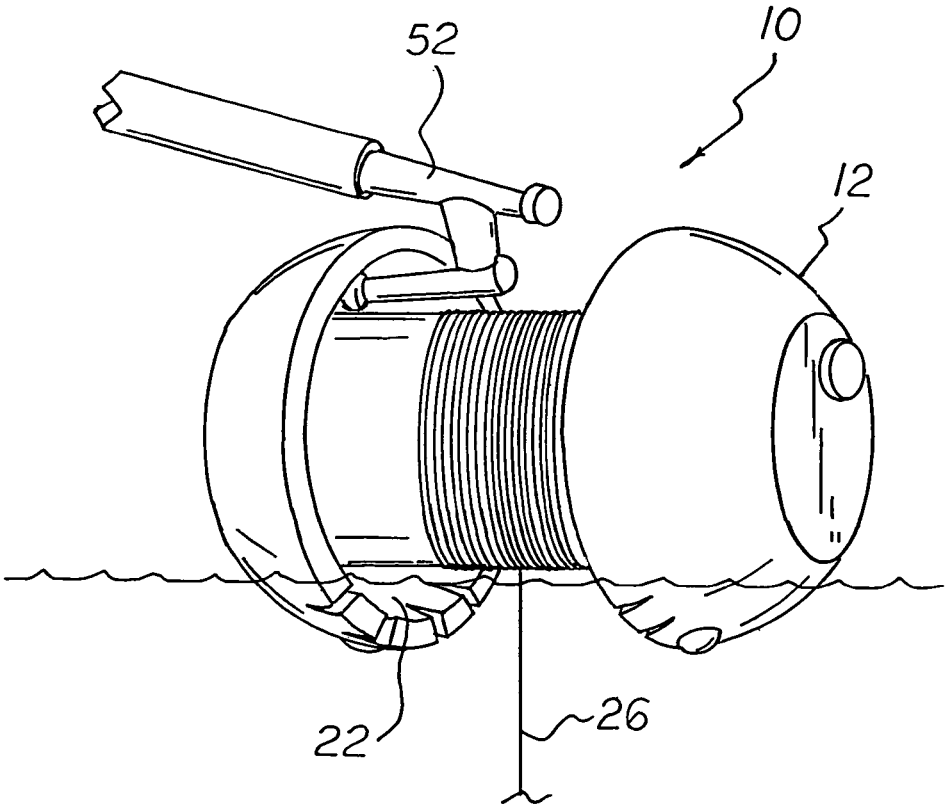
FIG 2

FIG 3
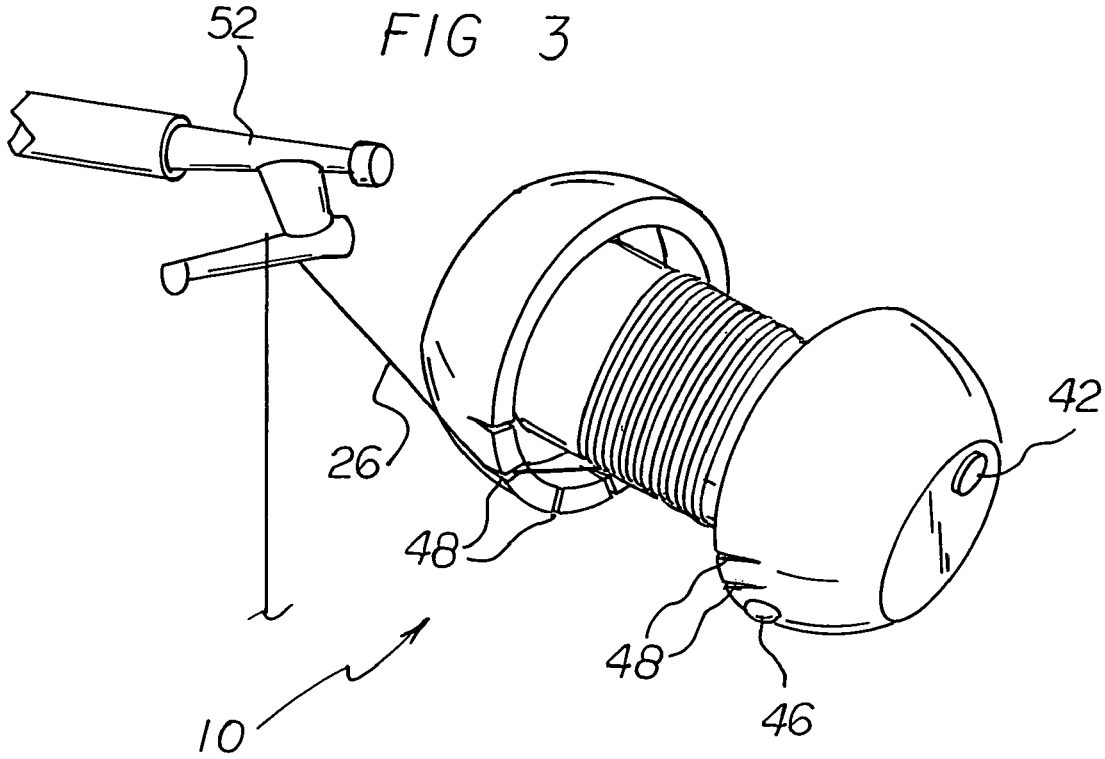
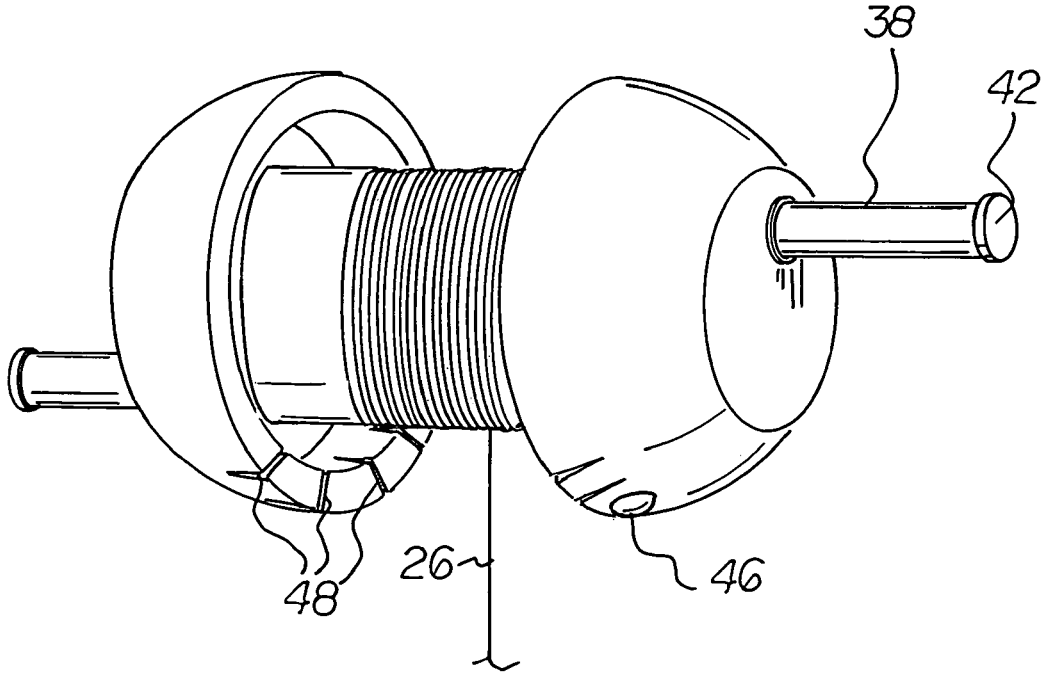
FIG 4

FIG 5
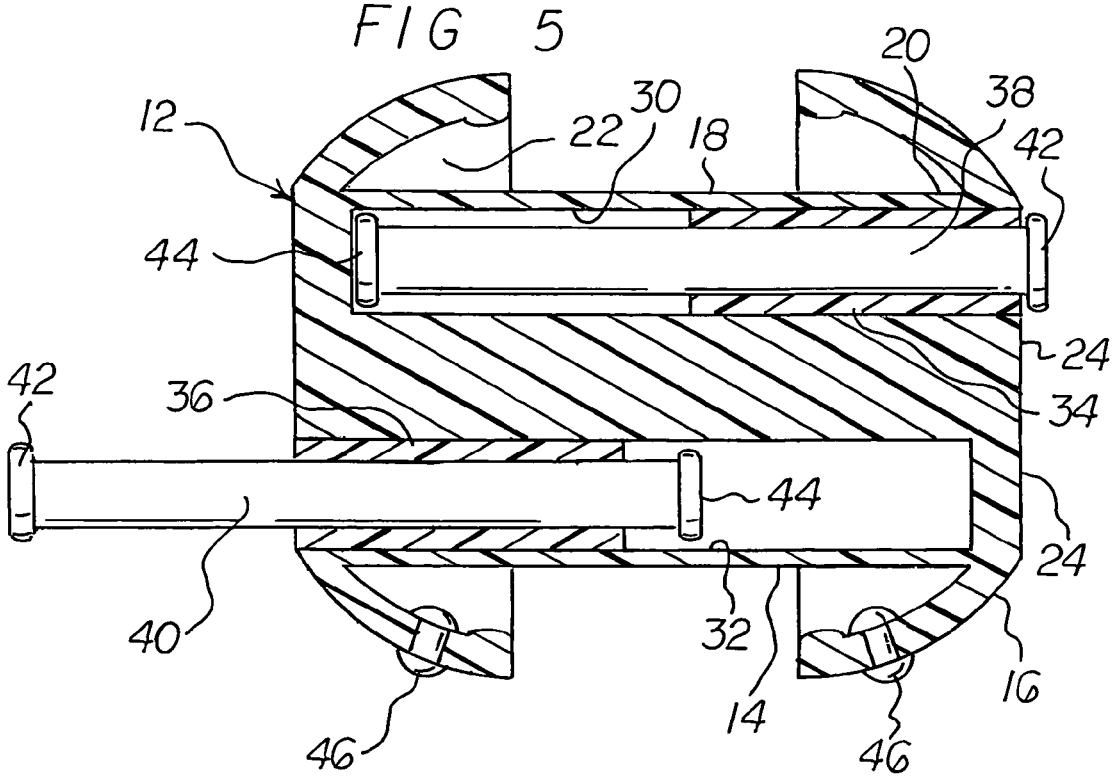
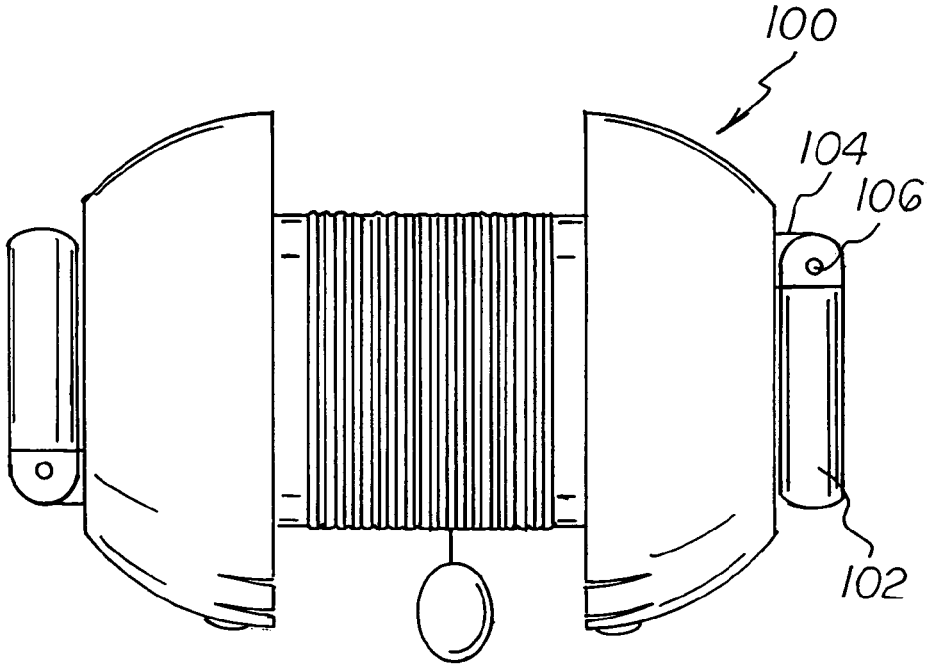
FIG 6

FIG 7
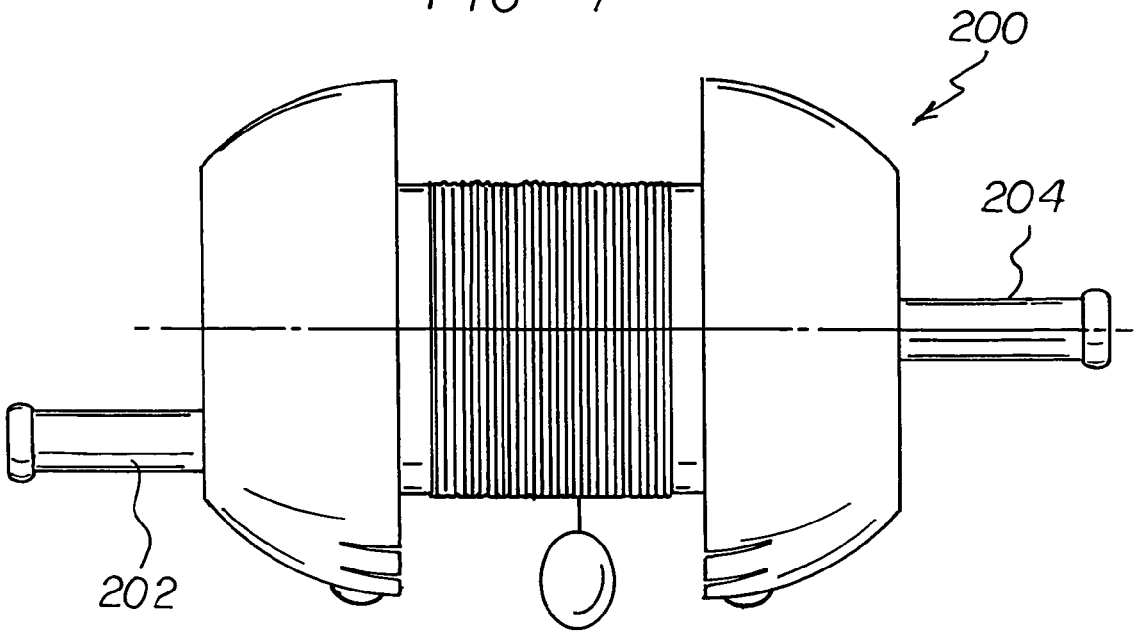
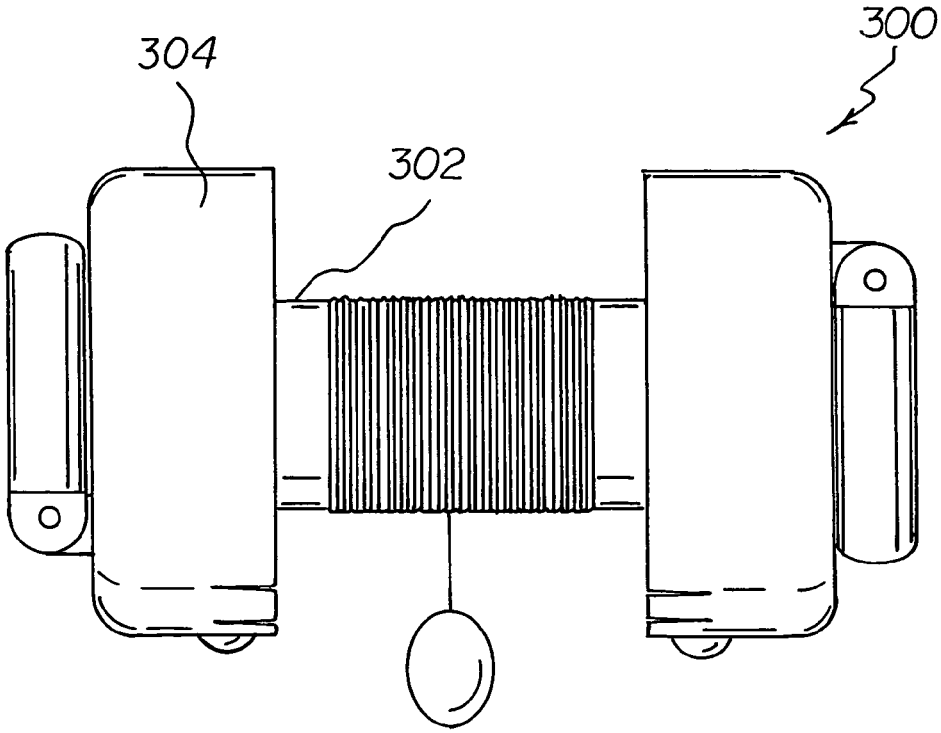
FIG 8

FIG 9
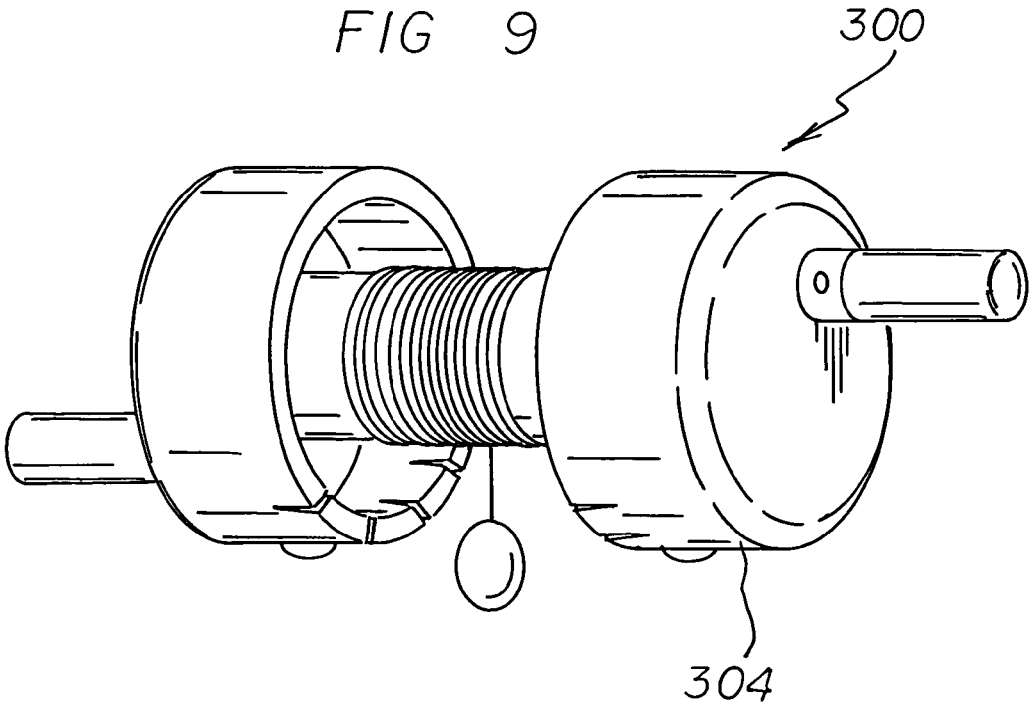
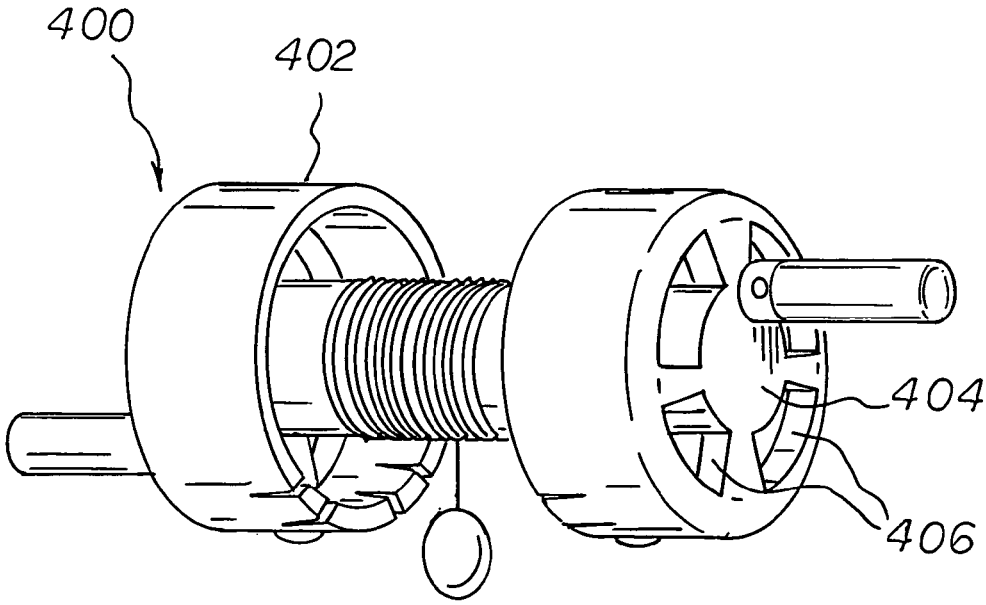
FIG 10

UNITARY REEL MARKER BUOY SYSTEM

BACKGROUND OF THE INVENTION

1. Field of the Invention

The present invention relates to a unitary reel marker buoy system and more particularly pertains to marking underwater sites of interest in a reliable, convenient and economical manner.

2. Description of the Prior Art

The use of marker systems of known designs and configurations is known in the prior art. More specifically, marker systems of known designs and configurations previously devised and utilized for the purpose of marking sites through known methods and configurations are known to consist basically of familiar, expected, and obvious structural configurations, notwithstanding the myriad of designs encompassed by the crowded prior art which has been developed for the fulfillment of countless objectives and requirements.

By way of example, U.S. Pat. Number 2,977,608 issued Apr. 4, 1961 to Brown relates to a Fishing Spot Marker. U.S. Pat. No. 4,501,563 issued Feb. 26, 1985 to Johnson relates to a Marker Buoy. U.S. Pat. No. 4,881,338 issued Nov. 21, 1989 to Lung relates to a Telescopic Gaff Hook Device. Lastly, U.S. Pat. No. 5,087,216 issued Feb. 11, 1992 to Noggle relates to a Fisherman's Marker Buoy with Integral Reel.

While these devices fulfill their respective, particular objectives and requirements, the aforementioned patents do not describe a unitary reel marker buoy system that allows marking underwater sites of interest in a reliable, convenient and economical manner.

In this respect, the unitary reel marker buoy system according to the present invention substantially departs from the conventional concepts and designs of the prior art, and in doing so provides an apparatus primarily developed for the purpose of marking underwater sites of interest in a reliable, convenient and economical manner.

Therefore, it can be appreciated that there exists a continuing need for a new and improved unitary reel marker buoy system which can be used for marking underwater sites of interest in a reliable, convenient and economical manner. In this regard, the present invention substantially fulfills this need.

SUMMARY OF THE INVENTION

In view of the foregoing disadvantages inherent in the known types of marker systems of known designs and configurations now present in the prior art, the present invention provides an improved unitary reel marker buoy system. As such, the general purpose of the present invention, which will be described subsequently in greater detail, is to provide a new and improved unitary reel marker buoy system and method which has all the advantages of the prior art and none of the disadvantages.

To attain this, the present invention essentially comprises a unitary reel marker buoy system. First provided is a buoyant assembly. The buoyant assembly has a central reel and end rings. The central reel has a central support section. The central reel has end sections. The central reel is cylindrical. The central reel has an oval cross sectional configuration. The central reel has a central axis. The central reel has a vertically disposed major axis and a horizontally disposed minor axis. The end rings are in a truncated hemispherical configuration. The end rings have a recessed interior. The end rings have a circular exterior. The end sections of the central reel are coupled to the recessed interiors of the end sections. The central reel and end rings are fabricated from a buoyant material, such as a natural or synthetic material. The buoyant material is selected from the class of buoyant materials. The class of buoyant materials includes natural materials such as wood and cork, as well as synthetic materials. The materials may be made buoyant by virtue of the configuration used, such as a hollow configuration. Synthetic materials that may be configured as to be buoyant may be materials such as acrylonitrile-butadiene-styrene, polyvinyl chloride, polyethylene, polystyrene foam and polyethylene foam. Other materials, such as stainless steel, may be made to be buoyant by virtue of configuring such a material in a hollow shape.

A line is provided. The line has an interior end. The interior end is coupled to the central support section. The line has an exterior end. A weight is provided. The weight is secured to the exterior end of the line. An intermediate length is provided there between coiled around the central support section. The weight has a generally spheroid configuration. The weight has a diameter. The diameter is adapted to be frictionally retained between one end section of the central support section and the recessed interior of an adjacent end ring.

Provided next is a handle assembly. The handle assembly includes a cylindrical first bore and a cylindrical second bore. Each bore extends from an associated circular exterior of an end ring for at least a majority of the length of the central reel. A rigid sleeve is provided within each bore. The rigid sleeve extends from adjacent to an associated circular exterior to adjacent a midpoint of its associated bore. A handle is provided. The handle is adapted to slide within its associated sleeve and bore between a retracted orientation within the bore and an extended orientation exterior of the bore. Each handle has exterior enlargements. The exterior enlargements preclude the handles from retracting within its associated bore. Each handle has interior enlargements. The interior enlargements preclude the handles from being totally withdrawn from its associated bore. The handles are parallel to the central axis and on opposite sides thereof. The handles are configured to be moved to their extended orientations for winding line onto the central support section. The handles are configured to be moved to their retracted orientations when floating in water with line unwound to mark an underwater site of interest, or when the device is being stored.

Further provided is a counter weight. The counter weight is secured to each end ring along a major axis. The counter weight functions to hold the buoy in a stable position when deployed and floating. This keeps the line from unnecessary unraveling.

Also provided is at least one V-shaped notch in association with the counter weight. If more than one notch is employed, then the notches are closely spaced. The notch is formed in each end ring on opposite sides of its associated counterweight. Each notch is sized to receive and frictionally retain a portion of line when the buoyant assembly, or buoy, is being retrieved, that is, after the unreeling of line from the central support section.

Provided last is a gaff assembly. The gaff assembly has a handle end (not shown). The handle end may be manipulated by a user. The gaff assembly has a hook end. The hook end is adapted to contact and restrain an end ring at its recessed interior and to position the line into a notch. Using the hook end of the gaff to engage the buoy keeps the buoy from letting out more line as it is raised from the water.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved unitary reel marker buoy system which has all of the advantages of the prior art marker systems of known designs and configurations and none of the disadvantages.

It is another object of the present invention to provide a new and improved unitary reel marker buoy system which may be easily and efficiently manufactured and marketed.

It is further object of the present invention to provide a new and improved unitary reel marker buoy system which is of durable and reliable constructions.

An even further object of the present invention is to provide a new and improved unitary reel marker buoy system which is susceptible of a low cost of manufacture with regard to both materials and labor, and which accordingly is then susceptible of low prices of sale to the consuming public, thereby making such unitary reel marker buoy system economically available to the buying public.

Even still another object of the present invention is to provide a unitary reel marker buoy system for marking underwater sites of interest in a reliable, convenient and economical manner.

Lastly, it is an object of the present invention to provide a new and improved unitary reel marker buoy system. A buoyant assembly has a central reel and end rings. The central reel has a central support section with end sections. The end sections of the central reel are coupled to the end reels. The central reel and end rings are fabricated from a buoyant elastomer. A line has an interior end coupled to the central support section. The line has an exterior end with a weight secured thereto. The line has an intermediate length there between coiled around the central support section. Handles are adapted to move between retracted and extended orientations. The handles are adapted to be moved to their extended orientations for winding line onto the central support section. The handles are adapted to be moved to their retracted orientations when floating in water with the line unwound to mark an underwater site of interest.

The method of function of the buoyant system is the user places the buoy in the water. The weight attached to the line takes the line downward, turning the buoy in the water and causing more line to be let out. The weight on the line is greater than the counter weight on the buoy itself, so the device turns and lets out more line. When the bottom is reached by the weight, the counter weights then exceed the pull of the line and the buoy no longer spools out line. The counter weights then cause the buoy to be stable. This weighted stability causes the buoy to not turn in the water, and no more line than is necessary is released from the central spool of the buoy.

When the user retrieves the buoy, he may use a gaff or other hooking means to reach into the recess or apertures. This mode of engagement prevents the buoy from further unspooling more line. This allows the user to pick up, extend the handles, and retrieve the line that was unspooled from the device. The handles being offset allow the user to quickly and efficiently retrieve the extended or unspooled line by winding the line back onto the central reel portion of the device. If the user hooks the line, the notches will capture the line and prevent further unspooling as the buoy is lifted out of the water.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a unitary reel marker buoy system constructed in accordance with the principles of the present invention.

FIG. 2 is a perspective illustration of the system illustrated in FIG. 1.

FIG. 3 is a perspective illustration similar to FIG. 2 but with the line in a locked orientation.

FIG. 4 is a perspective illustration of the system of the prior Figures but with the handled in the extended cranking orientation.

FIG. 5 is a cross sectional view taken along the central axis with one handle in a retracted orientation and the other handle in a partially extended orientation.

FIG. 6 is a front elevational view similar to FIG. 1 but illustrating an alternate embodiment of the invention with folding handles.

FIG. 7 is a front elevational view similar to FIG. 1 but illustrating another alternate embodiment of the invention with one central handle.

FIG. 8 is a front elevational view similar to FIG. 1 but illustrating another alternate embodiment of the invention with a circular central reel.

FIG. 9 is a perspective illustration of the alternate embodiment of the invention shown in FIG. 8 with a cylindrical end rings.

FIG. 10 is a perspective illustration similar to FIG. 9 but illustrating another alternate embodiment of the invention with apertured end rings.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved unitary reel marker buoy system embodying the principles and concepts of the present invention and generally designated by the reference numeral 10 will be described.

The present invention, the unitary reel marker buoy system 10 is comprised of a plurality of components. Such components in their broadest context include a buoyant assembly, a line and handles. Such components are individually configured and correlated with respect to each other so as to attain the desired objective.

First provided is a buoyant assembly, also known as a buoy 12. The buoyant assembly has a central reel 14 and end rings 16. The central reel has a central support section 18. The central reel has end sections 20. The central reel is cylindrical. The central reel has an oval cross sectional configuration. The central reel has a central axis. The central reel has a vertically disposed major axis and a horizontally disposed minor axis. The end rings are in a truncated hemispherical configuration. The end rings have a recessed interior 22. The recessed interior may be either continuous or interrupted. The recessed area provides a structure in which a gaff or other hooking device may be contacted wit the buoy. The recessed area may have associated apertures. The end rings have a circular exterior 24. The end sections of the central reel are coupled, preferably integrally formed, to the recessed interiors of the end sections. The central reel and end rings are fabricated from a buoyant material. The buoyant material may be either natural, such as wood or cork, or it may be synthetic. The materials, such as stainless steel, may be made buoyant by virtue of the configuration used, such as a hollow configuration. Synthetic materials that may be configured as to be buoyant may be materials such as acrylonitrile-butadiene-styrene, polyvinyl chloride, polyethylene, polystyrene foam and polyethylene foam. Other materials, such as stainless steel, may be made to be buoyant by virtue of configuring such a material in a hollow shape.

A line 26 is provided. The line has an interior end. The interior end is coupled to the central support section. The line has an exterior end. A weight 28 is provided. The weight is secured to the exterior end of the line. The weight functions to pull the line from the spooled position on the central reel down toward the sea or lake bed. The line has an intermediate length. The intermediate length is provided between that line that is attached to the central reel and the weight. The intermediate length is coiled around the central support section of the central reel. The weight preferably has a generally spheroid configuration, but the weight may have any configuration. The weight has a diameter. The diameter is adapted to be frictionally retained between one end section of the central support section and the recessed interior of an adjacent end ring during storage and non-use. During use, when marking an underwater location of interest, the weight will function to rotate the buoyant assembly and unwind line by pulling on the line. The weight continues to unwind the line until the weight reaches the bottom.

Provided next is a handle assembly. The handle assembly includes a cylindrical first bore 30 and a cylindrical second bore 32. Each bore extends from an associated circular exterior of an end ring for at least a majority of the length of the central reel. A rigid sleeve 34, 36 is provided within each bore. The rigid sleeve extends from adjacent to an associated circular exterior to adjacent a midpoint of its associated bore. A handle 38, 40 is provided. The handle is adapted to slide within its associated sleeve and bore between a retracted orientation within the bore and an extended orientation exterior of the bore. Each handle has exterior enlargements 42. The exterior enlargements preclude the handles from retracting within its associated bore. Each handle has interior enlargements 44. The interior enlargements preclude the handles from being totally withdrawn from its associated bore. The handles are parallel to the central axis and on opposite sides thereof. The handles are adapted to be moved to their extended orientations for winding line onto the central support section. The handles are configured to be moved to their retracted orientations when floating in water, such as being used to mark an underwater site of interest, or when the buoy is being stored. The handles function to facilitate rotation of the buoyant assembly by a user when winding line on to the central support section of the central reel.

Further provided is at least one counter weight 46. Preferably there are more than one counter weights employed. The counter weight is secured to each end ring and is radially located.

Also provided is at least one V-shaped notch 48. The notch is associated with the counter weight. In the preferred embodiment there are a plurality of notches employed. The notches are closely spaced. The notches are formed in each end ring on opposite sides of the associated counterweight. Each notch is sized to receive and frictionally retain a portion of line when the buoy is being retrieved, as is done after the unreeling of line from the central support section. The counter weight functions to retain the major axis of the central reel horizontal and the minor axis of the central reel vertical during use of the system, such as while marking an underwater location of interest.

Provided last is a gaff assembly. The gaff assembly has a handle end (not shown). The handle end may be manipulated by a user. The gaff assembly has a hook end 52. The hook end is configured to contact and restrain an end ring at its recessed interior. In so engaging the buoy, the buoy is kept from further unspooling any additional line as the buoy is lifted from the water and retrieved. The gaff may also be used to capture the line. As the line is pulled upward, the line then engages a notch, and is positioned in a notch. The notch then retains the line and prevents further unspooling of additional line as the buoy is lifted from the water and retrieved.

An alternate embodiment 100 of the present invention is illustrated in FIG. 6. The handles 102 include stubs 104 on the rings. Pivot pins 106 are provided. The pivot pins pivot the handles between the retracted and extended orientations.

Another alternate embodiment 200 of the present invention is illustrated in FIG. 7. The handles 202, 204 include one central handle 204 on the axis of the central support section and one handle 202 parallel therewith and offset there from.

Another alternate embodiment 300 of the present invention is illustrated in FIGS. 8 and 9. The central support section 302 has a circular cross sectional configuration. Further, the end sections 304 are of a cylindrical configuration.

The final alternate embodiment 400 of the present invention is illustrated in FIG. 10. The end sections 402 are of a cylindrical configuration with exterior faces 404 formed with apertures 406.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A unitary reel marker buoy system:

a buoyant assembly having a central reel and end rings, the central reel having a central support section with end sections, the end sections of the central reel being coupled to the end rings, the central reel and end rings being fabricated from a buoyant material;

a line having an interior end coupled to the central support section and an exterior end and an intermediate length there between coiled around the central support section; and a pair of opposing handles configured to move between retracted and extended orientations, the handles adapted to be moved to their extended orientations for winding line onto the central support section, the handles configured to be moved to their retracted orientations.

2. The system as set forth in claim 1 wherein the handles include stubs on the rings with pivot pins for pivoting the handles between the retracted and extended orientations.

3. The system as set forth in claim 1 wherein the handles include with one central handle on the central axis of the central reel and one handle parallel therewith and offset there from.

4. The system as set forth in claim 1 wherein the handles are oppositely located and parallel to each other and offset from each other.

5. The system as set forth in claim 1 wherein the central reel has a circular cross sectional configuration.

6. The system as set forth in claim 1 wherein the end rings have a cylindrical configuration.

7. The system as set forth in claim 1 wherein the end rings are of a cylindrical configuration with exterior faces formed with apertures.

8. The system as set forth in claim 1 and further includes at least one counter weight secured to an end ring.

9. The system as set forth in claim 1 wherein there is at least one V-shaped notch formed in the end ring, the notch being sized to receive and frictionally retain a portion of line.

10. The system as set forth in claim 1 wherein there are a plurality of V-shaped notches located in the end rings and associated with a counter weight, with notches being located on opposite sides of the associated counterweight.

11. The system as set forth in claim 1 and further including:

a gaff assembly having a handle end for manipulation by a user and a hook end, the hook end adapted to contact and restrain an end ring.

12. The system as set forth in claim 1 wherein the end ring has at least one recessed area, the recessed area being configured to allow placement of a gaff hook for retrieval.

13. A unitary reel marker buoy system for marking underwater sites of interest in a reliable, convenient and economical manner comprising, in combination:

a buoyant assembly having a central reel and end rings, the central reel having central support section with end sections, the central reel being cylindrical with an oval cross sectional configuration having a central axis with a vertically disposed major axis and a horizontally disposed minor axis, the end rings being in a truncated hemispherical configuration with a recessed interior and a circular exterior, the end sections of the central reel being coupled to the recessed interiors of the end sections, the central reel and end rings being fabricated in a buoyant configuration;

a line having an interior end coupled to the central support section and an exterior end with a weight secured thereto and an intermediate length there between coiled around the central support section, the weight having a generally spheroid configuration with a diameter configured to be frictionally retained between one end section of the central support section and the recessed interior of an adjacent end ring;

a handle assembly including a cylindrical first bore and a cylindrical second bore, each bore extending from an associated circular exterior of an end ring for at least a majority of the length of the central reel with a rigid sleeve within each bore and extending from an associated circular exterior to adjacent a midpoint of its associated bore with a handle adapted to slide within its associated sleeve and bore between a retracted orientation within the bore and an extended orientation exterior of the bore, each handle having exterior enlargements to preclude the handles from retracting within its associated bore and interior enlargements to preclude the handles from being totally withdrawn from its associated bore, the handles being parallel to the central axis and on opposite sides thereof, the handles configured to be moved to their extended orientations for winding line onto the central support section, the handles configured to be moved to their retracted orientations when the system is deployed;

a counter weight secured and radially located on each end ring with a plurality of closely spaced V-shaped notches formed in each end ring on opposite sides of its associated counter weight, each notch being sized to receive and frictionally retain a portion of line when the system is being retrieved; and a gaff assembly having a handle end for manipulation by a user and a hook end, the hook end configured to contact and restrain an end ring at its recessed interior and to position the line into a notch.

* * * * *